US007239826B2

(12) United States Patent
Kuntz et al.

(10) Patent No.: US 7,239,826 B2
(45) Date of Patent: Jul. 3, 2007

(54) METHOD FOR REPAIRING USED FUSER MEMBER

(75) Inventors: Alan R. Kuntz, Webster, NY (US); Frank P. Sgabellone, Macedon, NY (US); Saquiequois J. Bissouma, Webster, NY (US)

(73) Assignee: Xerox Corporation, Stamford, CT (US)

( * ) Notice: Subject to any disclaimer, the term of this patent is extended or adjusted under 35 U.S.C. 154(b) by 182 days.

(21) Appl. No.: 11/220,509

(22) Filed: Sep. 6, 2005

(65) Prior Publication Data

US 2007/0053714 A1 Mar. 8, 2007

(51) Int. Cl.
*G03G 15/00* (2006.01)
*G03G 15/20* (2006.01)

(52) U.S. Cl. ..... 399/109; 399/330

(58) Field of Classification Search ..... 29/402.06, 29/895.1, 895.3; 399/109, 327, 330
See application file for complete search history.

(56) References Cited

U.S. PATENT DOCUMENTS 6,289,587 B1 * 9/2001 Battat et al. ..... 29/895.1

* cited by examiner

*Primary Examiner*—Hoang Ngo
(74) *Attorney, Agent, or Firm*—Annette L. Bade

(57) ABSTRACT

A process for renewing an outer surface of a used fuser roller by removing debris particles from the surface including contacting the outer surface with a first finishing paper while simultaneously rotating the used fuser roller so that the first finishing paper completes a first superfinishing of the outer layer; b) optionally contacting the outer surface with a second finishing paper while simultaneously rotating the used fuser roller so that the second finishing paper completes a second superfinishing of the outer layer; c) optionally contacting the outer surface with a third finishing paper while simultaneously rotating the used fuser roller so that the third finishing paper completes a third superfinishing of the outer layer; and d) repeating a) until obtaining a first measured gloss value of from about 10 to about 50 GGU, optionally repeating b) until obtaining a second measured gloss value of from about 30 to about 70 GGU, and optionally repeating c) until obtaining a third measured gloss value of from about 65 to about 80 GGU.

21 Claims, 1 Drawing Sheet

METHOD FOR REPAIRING USED FUSER MEMBER

BACKGROUND

Herein are described a process for repairing used fuser members in an attempt to return them back to near-original condition. After a fuser roller has been installed in an electrophotographic, electrostatographic, xerographic, or like machine, for example a copy or printing machine, the combination of fuser oil or fuser release agent, such as silicone oil and toner, forms a sticky gel that adheres to the fuser roll surface. In turn, this coating reduces the fuser roll performance and life. Ultimately this gel will cause the fuser roll to fail based on print or copy quality. Described herein is a method that will strip away the gel and generate a new, almost original fuser roller. The process entails using a superfinishing process, and a series of finishing papers. In embodiments, specific grit (having specific particle size ranges) of paper is used. Also, in embodiments, a certain number of passes are used. In embodiments, the roll profile is straightened. Specifically, in the event that the roller may have grooves in it from paper edge wear, these grooves will be removed by embodiments of the process described herein.

In a typical electrostatographic printing apparatus, a light image of an original to be copied is recorded in the form of an electrostatic latent image upon a photosensitive member and the latent image is subsequently rendered visible by the application of toner. The visible toner image is then in a loose powdered form and can be easily disturbed or destroyed. The toner image is usually fixed or fused upon a support, which may be a photosensitive member itself, or other support sheet such as plain paper.

The use of thermal energy for fixing toner images onto a support member is well known. In order to fuse toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, thermoplastic resin particles are fused to the substrate by heating to a temperature of between about 90° C. to about 160° C. or higher depending upon the softening range of the particular resin used in the toner. It is not desirable, however, to raise the temperature of the substrate substantially higher than about 200° C. because of the tendency of the substrate to discolor at such elevated temperatures particularly when the substrate is paper.

Several approaches to thermal fusing of toner images have been described in the art. These methods include providing the application of heat and pressure substantially concurrently by various means: a roll pair maintained in pressure contact; a belt member in pressure contact with a roll; and the like. Heat may be applied by heating one or both of the rolls, plate members or belt members. The fusing of the toner particles takes place when the proper combination of heat, pressure and contact time are provided. The balancing of these parameters to bring about the fusing of the toner particles is well known in the art, and they can be adjusted to suit particular machines or process conditions.

After repeated fusing cycles, the fusing surface of the fusing member will eventually exhibit unsatisfactory toner release, leading to poor quality prints. More specifically, as set forth above, after a fuser roller has been installed in an electrophotographic, electrostatographic, xerographic, or like machine, for example a copy or printing machine, the combination of fuser oil or fuser release agent, such as silicone oil, and toner forms a sticky gel that adheres to the roll surface. In turn, this coating reduces the roll performance and life. Ultimately this gel will cause the roll to fail based on print or copy quality. Typically, the fuser member is then either tossed away or recycled by stripping off all the coatings and then recoating the substrate to produce a new fuser member.

U.S. Pat. No. 6,289,587 discloses a method for reusing a fuser member comprised of an outer layer having an original fusing surface that is deficient, and the process involves removing a portion of the thickness of the outer layer including the original fusing surface to create on the remaining outer layer a new fusing surface.

Known processes for renewing the surface of a used fuser member include simple polishing of the outside surface of the fuser roller with sandpaper. Although this process may remove some of the gel, the roll produced was not straight and may not have had the same diameter as a new roll. Also, the print quality was compromised. Further, such renewed rollers did not have increased roller life, and failed within an undesirable amount of time.

Thus, there is a need for an improved process for renewing the surface of a used fuser roller, which also allows for a straight roll profile, wherein the roller grooves from paper edge wear are removed. In addition, there is a need for an improved process for renewing the surface of a used fuser roller, wherein the roller produced has an increased life over other fuser rollers processed by known renewal methods. In addition, there is a need for improved print quality.

SUMMARY

Embodiments include a process for renewing an outer surface of a used fuser roller by removing debris particles from the surface, the process comprising a) contacting the outer surface with a first finishing paper while simultaneously rotating the used fuser roller so that the first finishing paper completes a first superfinishing of the outer layer; b) optionally contacting the outer surface with a second finishing paper while simultaneously rotating the used fuser roller so that the second finishing paper completes a second superfinishing of the outer layer; c) optionally contacting the outer surface with a third finishing paper while simultaneously rotating the used fuser roller so that the third finishing paper completes a third superfinishing of the outer layer; and d) repeating a) until obtaining a first measured gloss value of from about 10 to about 50 GGU, optionally repeating b) until obtaining a second measured gloss value of from about 30 to about 70 GGU, and optionally repeating c) until obtaining a third measured gloss value of from about 65 to about 80 GGU.

Embodiments also include a process for renewing an outer surface of a used fuser roller by removing debris particles from the surface, the process comprising a) contacting the outer surface with a first finishing paper having a particle size of from about 10 to about 20 microns while simultaneously rotating the used fuser roller so that the first finishing paper completes a first superfinishing of the outer layer; b) repeating a) to from about 1 to about 5 passes until obtaining a first measured gloss value of from about 10 to about 50 GGU; c) contacting the outer surface with a second finishing paper having a particle size of from about 1 to about 20 microns while simultaneously rotating the used fuser roller so that the second finishing paper completes a second superfinishing of the outer layer; d) repeating c) to from about 5 to about 10 passes until obtaining a second measured gloss value of from about 30 to about 70 GGU; and e) contacting the outer surface with a third finishing paper having a particle size of from about 1 to about 10 microns, while simultaneously rotating the used fuser roller so that the third finishing paper completes a third superfinishing of the outer layer; f) repeating e) to from about 1 to about 10 passes until obtaining a third measured gloss value of from about 65 to about 80 GGU.

In addition, embodiments include a process for renewing an outer surface of a used fuser roller by removing debris particles from the surface, the process comprising a) contacting the outer surface with a first silicon carbide finishing paper having a particle size of from about 10 to about 20 microns while simultaneously rotating the used fuser roller so that the first finishing paper completes a first superfinishing of the outer layer; b) repeating a) to from about 1 to about 5 passes until obtaining a first measured gloss value of from about 10 to about 50 GGU; c) contacting the outer surface with a second silicon carbide lapping film having a particle size of from about 1 to about 20 microns while simultaneously rotating the used fuser roller so that the second finishing paper completes a second superfinishing of the outer layer; d) repeating c) to from about 5 to about 10 passes until obtaining a second measured gloss value of from about 30 to about 70 GGU; e) contacting the outer surface with a third silicon carbide lapping paper having a particle size of from about 1 to about 10 microns, while simultaneously rotating the used fuser roller so that the third finishing paper completes a third superfinishing of the outer layer; and f) repeating e) to from about 1 to about 10 passes until obtaining a third measured gloss value of from about 65 to about 80 GGU.

BRIEF DESCRIPTION OF THE DRAWINGS

Reference may be had to the accompanying drawing, which includes.

DETAILED DESCRIPTION

Figure 1:
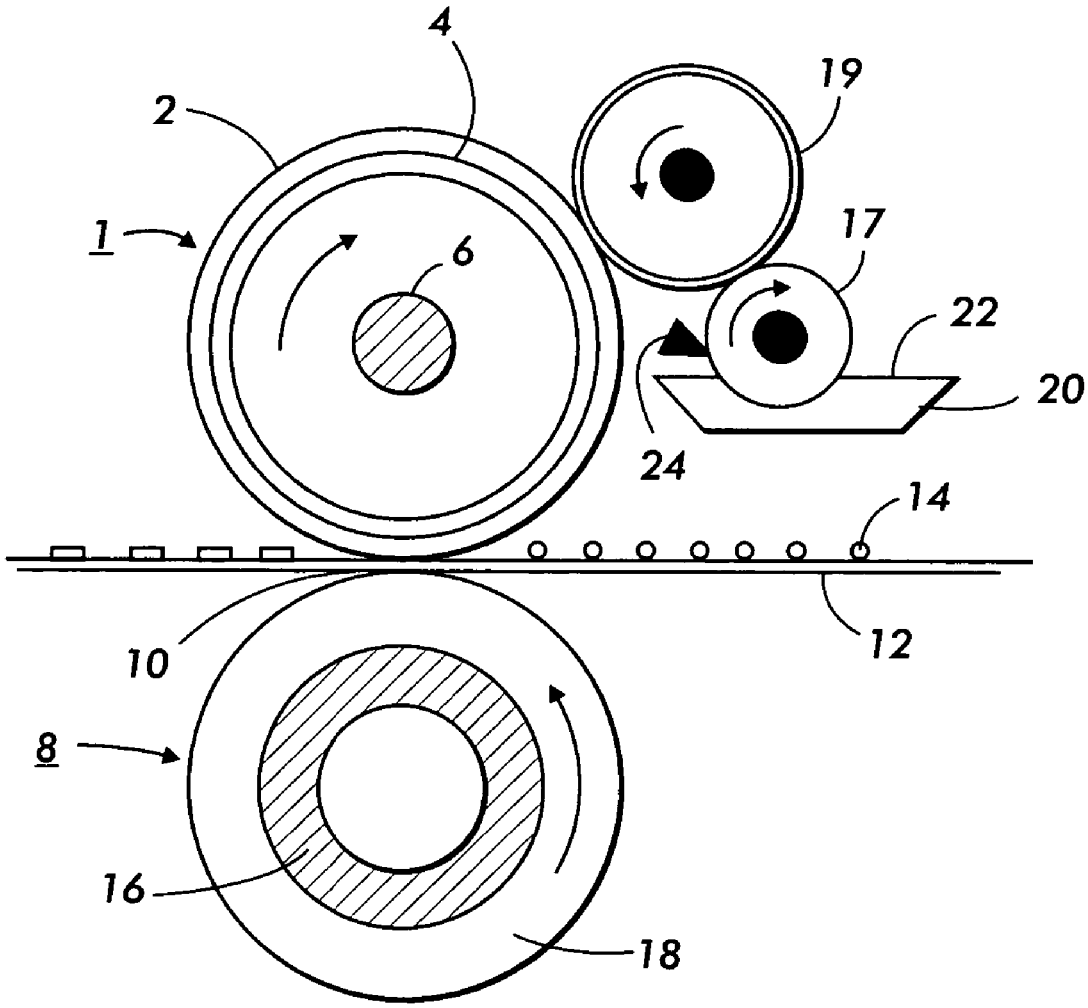
FIG. 1 is a sectional view of a fuser system, which may use a fuser roller having a new surface prepared in accordance with the superfinishing process described herein.

The fuser member renewed by the process described herein is pictured in conjunction with a fuser assembly as shown in FIG. 1 where the numeral 1 designates a fuser member which is in the configuration of a roll including outer layer 2 upon suitable base member 1 which is a hollow cylinder or core fabricated from any suitable metal such as aluminum, anodized aluminum, steel, nickel, copper, and the like, having a suitable heating element 6 disposed in the hollow portion thereof which is coextensive with the cylinder. Backup or pressure roll 8 cooperates with fuser roll 1 to form a nip or contact arc 10 through which a copy paper or other substrate 12 passes such that toner image 14 thereon contacts the surface of the outer layer 2 of fuser roll 1. As shown in FIG. 1, the backup roll 8 has a rigid hollow steel core 16 with a soft surface layer 18 thereon. Sump 20 contains polymeric release agent 22 which may be a solid or liquid at room temperature, but is a fluid at operating temperatures.

In the embodiment shown in FIG. 1 for applying the polymeric release agent 22 to outer layer 2, two release agent delivery rolls 17 and 19 rotatably mounted in the direction indicated are provided to transport release agent 22 from the sump 20 to the outer layer 2. As illustrated in FIG. 1, roll 17 is partly immersed in the sump 20 and transports on its surface release agent from the sump to the delivery roll 19. By using a metering blade 24 a layer of polymeric release fluid can be applied initially to the delivery roll 19 and subsequently to outer layer 2 in controlled thickness ranging from submicrometer thickness to thickness of several micrometers of release fluid. Thus, by metering device 24 about 0.1 to 2 micrometers or greater thickness of release fluid can be applied to the surface of elastomer surface layer 2.

The fuser member may be a roll, belt, flat surface or other suitable shape used in the fixing of thermoplastic toner images to a suitable substrate. Typically, the fuser member is made of a hollow cylindrical metal core, such as copper, aluminum, steel and like, and has an outer layer of the selected cured fluoroelastomer. Alternatively, there may be one or more thermally conductive intermediate layers between the substrate and the outer layer of the cured elastomer if desired.

Currently, some fuser rollers are failing at a low print count of from about 5,000 to about 225,000 for unacceptable print quality due to offset (toner adhering to the fuser roller). More specifically, a combination of oil, such as silicone fuser oil, and toner forms a sticky gel that adheres to the roller surface and reduces the rolls performance and life. Ultimately, this gel will cause the roll to fail based on print or copy quality. Other failures are from delta gloss on the print (edge wear on the fuser roller), and print artifacts (gelled oil on the fuser roller).

Herein is described a process for renewing the surface of a used fuser roller. In embodiments, the process includes cleaning the outer surface, followed by superfinishing the outer surface to remove debris and to remove grooves, thereby restoring the outer surface to usable quality.

Fuser rollers may have outer coatings such as silicone intermediate layers with fluoroelastomer outer layers. The outer fluoroelastomer coating can be from about 1 to about 50, or from about 20 to about 30 microns thick. In embodiments, the used fuser rollers are sorted for fuser rollers that have an intact fluoroelastomer or other outer coating. An example of a suitable fluoroelastomer coating is a copolymer or terpolymers of vinylidene fluoride, hexafluoropropylene and tetrafluoroethylene. A tetrapolymer would also include a cure site monomer. Examples include those copolymers, terpolymers and/or tetrapolymers being sold under the name VITON®, from DuPont, such as VITON® GF. For example, suitable candidates for this process include fuser rollers, which do not have any cuts or silicone rubber (or other intermediate layer) exposed.

To begin with, the surface of the used fuser roller can be optionally cleaned using suitable solvents such as toluene, hexane, heptane, OS20 (volatile methylsiloxanes, NATRASOLVE (Natural Citris Solvenated Degrease), and the like. This cleaning removes the non-gelled silicone oil from the outer surface.

In embodiments, superfinishing can be used to remove the debris build-up on the outer surface of the used fuser roller. Superfinishing can be accomplished by an automated machine, which uses abrasive paper with oscillation and pressure. The finishing papers are pressed onto and slightly wrapped around the outside of the roller and driven over the surface at specific oscillation, feeds and pressures. The rollers are worked down to a very fine polishing media. The finishing papers can include finishing paper, lapping film such as Imperial lapping film, lapping paper such as Imperial lapping paper, microfinishing film, and the like. The abrasives on the paper can include: silicon carbide, aluminum oxide, garnet, emery, chrome oxide, alumina-zirconia, diamond, ceramic aluminum oxide with particle sizes from 3 microns to 100 microns. In embodiments, the paper used in superfinishing is silicon carbide grit. In embodiments, silicone carbide grit can be purchased from 3M. Besides paper, the abrasives may be on cloth, paper, fiber combination, and polyester films. The grit can be bonded with glue, resin over glue, resin, and resin over resin. The removal processes described herein can be dry or with a coolant/lubricant fluid.

The superfinishing can be accomplished using a range of pressures, paper feeds, transverse rates and oscillation motions, with the used fuser roller rotating at a defined RPM (rotations per minute). One pass is one treatment of the roller with the superfinishing process. The number of passes can vary based on the condition of the used roller. If the roller has accumulated a large amount of debris, more passes may be required to remove the debris. Alternatively, if the roller has accumulated a smaller amount of debris, less passes may be required to remove the debris. Each superfinishing step may include from about 1 to about 10 passes, or from about 1 to about 9 passes, or from about 2 to about 8 passes. There may be 1, 2 and up to 3 or more steps in the superfinishing process.

The pressure used in the superfinishing process may be from about 10 to about 100 psi, or from about 20 to about 80 psi. The paper feeds used in the superfinishing process may be from about 5 to about 90 cm/min, or from about 10 to about 70 cm/min. The transverse rates used in the superfinishing process may be from about 100 to about 1,000 mm/min, or from about 200 to about 800 mm/min. The oscillation motions used in the superfinishing process may be from about 10 to about 100 percent, or from about 25 to about 75 percent. The RPM's used in the superfinishing process may be from about 100 to about 2,400 RPM's.

In embodiments, the superfinishing includes a succession of micro-finishing and lapping papers. For example, succession may include a first superfinishing with a paper having a first particle size, followed by a second superfinishing with a paper having a second particle size, and may include an additional optional third superfinishing step using a paper having a third particle size. These particles sizes may overlap.

Superfinishing may be accomplished in a series of steps, repeating the first step until a first measured gloss value is from about 10 to about 50 GGU, or from about 20 to about 40 GGU, optionally repeating a second step until a second measured gloss value is from about 30 to about 70 GGU, or from about 45 to about 70 GGU, and optionally repeating a third step until a third measured gloss value is from about 65 to about 80 GGU, or from about 65 to about 75 GGU. If multiple steps are used in the process, each may only need to be accomplished once.

An example would be a first superfinishing using a paper having a particle size of from about 10 to about 20 microns, or from about 12 to about 20 microns, or from about 15 to about 20 microns. This first superfinishing step can include from about 1 to about 5 passes, or from about 1 to about 2 passes. In embodiments, the first superfinishing step can include superfinishing with finishing paper having a first particle size of from about 10 to about 20 microns, or from about 12 to about 20 microns, or from about 15 to about 20 microns. This first superfinishing would be repeated until a first measured gloss value is from about 10 to about 50 GGU, or from about 20 to about 40 GGU is obtained.

The second superfinishing may be superfinishing using a paper having a particle size of from about 1 to about 20 microns, or from about 5 to about 10 microns, or from about 7 to about 9 microns. This second superfinishing step can include from about 5 to about 15 passes, or from about 5 to about 9 passes. In embodiments, the second superfinishing step can include superfinishing with lapping film such as Imperial lapping film having a first particle size of from about 1 to about 20 microns, or from about 5 to about 10 microns, or from about 7 to about 9 microns. This second superfinishing would be repeated until a second measured gloss value is from about 30 to about 70 GGU, or from about 45 to about 70 GGU is obtained.

The optional third superfinishing may be superfinishing using a paper having a particle size of from about 1 to about 10 microns, or from about 2 to about 8 microns, or from about 5 to about 7 microns. This third superfinishing step can include from about 1 to about 10 passes, or from about 2 to about 8 passes. In embodiments, the third superfinishing step can include superfinishing with lapping paper such as Imperial lapping paper having a first particle size of from about 1 to about 10 microns, or from about 2 to about 8 microns, or from about 5 to about 7 microns. This third superfinishing would be repeated until a third measured gloss value is from about 65 to about 80 GGU, or from about 65 to about 75 GGU is obtained.

In order to determine how many passes are needed in each superfinishing step, the gloss may be periodically measured. If the gloss is not at a desired certain level, superfinishing may be continued in order to obtain the desired level. When the gloss is restored to these levels, the roller is restored to approximate original gloss value. Each step, in an embodiment using multiple steps, may only need to go through 1 pass.

In embodiments, the outer layer, for example the outer fluoroelastomer layer, in an amount of from about 0.1 to about 2 microns, is removed during the superfinishing.

The superfinishing process is also used to straighten the roll profile. In the event that the roller has grooves in it from paper edge wear, these will be removed during the above superfinishing process. The finished roller will be as straight as, and/or have a diameter in the same range as, a new roll, in embodiments of the process.

The new fusing surface created by the superfinishing process may exhibit substantially the same toner release capability as a fresh or new fuser member. The new fusing surface has a toner release capability ranging for example from about 95% to 100%. What restoring the release capability of the fuser coating to 100% means is the fact that after removing some of the coating from the failed fuser member, the release capability of the remaining material is then equivalent to that of a virgin fuser member coating.

EXAMPLES

Example I

The used rollers were inspected and sorted, and cleaned with toluene. The rollers were re-finished by using a Superfinisher. The first step consisted of polishing the roller with one pass of a 15-micron microfinishing paper. A first measured gloss value was from 20 to 30 GGU. The second step used approximately 5 passes of a 9-micron lapping paper and gave a measured gloss value ranging from 55 to 65 GGU. The last step of this superfinishing process used from 2 to 4 passes of a 5-micron lapping paper in order to reach a measured gloss varying from 70 to 75 GGU. Details are shown below in Table 1.

TABLE 1

| | | Roller # | | | | | | | | |
|---|---|---|---|---|---|---|---|---|---|---|
| Paper | Passes | 1 | 2 | 3 | 4 | 5 | 6 | 7 | 8 | 9 |
| No | No | 67.2 | | 68.2 | 62.4 | 70.9 | 68.9 | 69.1 | 69.2 | 64.7 |
| 15u-5MIL MF S/C | 15u p1 | 35.6 | 25 | 26.9 | 26 | 25.2 | 32.9 | 22.5 | 28.7 | 29 |
| 9u-3MIL LAP S/C | 9u p1 | 34.4 | 40.1 | | | | | | | |
| | 9u p2 | 40.3 | 44.5 | | | | | | | |
| | 9u p3 | 45.1 | 54.5 | | | | | | | |
| | 9u p4 | 48.9 | 58.9 | | | | | | | |
| | 9u p5 | 54 | 61.8 | 56.7 | 53.8 | 55.2 | 62.7 | 52.6 | 61.2 | 60.3 |
| | 9u p6 | 56.3 | 62.5 | | | | | | | |
| | 9u p7 | 60.1 | | 60.7 | 58.2 | 62.9 | 67.9 | 59.6 | 66.4 | 61.6 |
| 5u-3MIL LAP S/C | 5u p1 | | | | | | | 66 | | |
| | 5u p2 | 67.8 | 70.8 | 72.6 | 67.7 | 68.9 | 73.8 | 68.4 | 73.9 | 71.1 |
| | 5u p3 | | | | | | | | 74.9 | |
| | 5u p4 | 66.3 | | | 72.2 | 73 | | 75.1 | | |

The repaired rollers were installed and tested on a Xerox machine using the Dark Dusting Test (100% Black, full coverage). A digital Color Gloss paper, 8.5"×14", 120 gsm, 80 lb was used to perform the test.

An amount of 2 to 5 sheets of uncoated plain paper were fed through the machine. The roller was then conditioned by printing the first 50 100% black full coverage sheets that were discarded. A total of 50 sheets of the 100% black full coverage sheets were used for the print quality evaluation. After testing, the hot roller was removed. The same procedure was repeated for each roller. During the test, the amount of paper jams was not substantially different from what was seen by use of a new roll.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A process for renewing an outer surface of a used fuser roller by removing debris particles from the surface, the process comprising a) contacting the outer surface with a first finishing paper while simultaneously rotating the used fuser roller so that the first finishing paper completes a first superfinishing of the outer layer;

b) optionally contacting the outer surface with a second finishing paper while simultaneously rotating the used fuser roller so that the second finishing paper completes a second superfinishing of the outer layer;

c) optionally contacting the outer surface with a third finishing paper while simultaneously rotating the used fuser roller so that the third finishing paper completes a third superfinishing of the outer layer; and d) repeating a) until obtaining a first measured gloss value of from about 10 to about 50 GGU, optionally repeating b) until obtaining a second measured gloss value of from about 30 to about 70 GGU, and optionally repeating c) until obtaining a third measured gloss value of from about 65 to about 80 GGU.

2. A process in accordance with claim 1, wherein the first measured gloss value is from about 20 to about 40 GGU.

3. A process in accordance with claim 1, wherein the used fuser roller comprises grooves, and wherein the grooves are substantially removed by the process.

4. A process in accordance with claim 1, wherein the first finishing paper, the optional second finishing paper, and the optional third finishing paper, all comprise a material selected from the group consisting of silicon carbide, aluminum oxide, alumina-zirconia, diamond, ceramic aluminum oxide, and mixtures thereof.

5. A process in accordance with claim 4, wherein the first finishing paper, the second finishing paper, and the third finishing paper all comprise silicon carbide.

6. A process in accordance with claim 1, wherein the first finishing paper has a particle size of from about 10 to about 20 microns.

7. A process in accordance with claim 6, wherein the particle size is from about 12 to about 20 microns.

8. A process in accordance with claim 1, wherein the first superfinishing goes through from about 1 to about 5 passes.

9. A process in accordance with claim 1, wherein the second finishing paper has a particle size of from about 1 to about 20 microns.

10. A process in accordance with claim 9, wherein the particle size is from about 5 to about 10 microns.

11. A process in accordance with claim 1, wherein the second superfinishing goes through from about 5 to about 10 passes.

12. A process in accordance with claim 1, wherein the third finishing paper has a particle size of from about 1 to about 10 microns.

13. A process in accordance with claim 12, wherein the particle size is from about 2 to about 8 microns.

14. A process in accordance with claim 1, wherein the third superfinishing goes through from about 1 to about 10 passes.

15. A process in accordance with claim 1, wherein subsequent to d), an amount of from about 1 to about 2 microns of the outer layer is removed.

16. A process in accordance with claim 1, wherein in a), b) and c), the used fuser roller is rotated at a rate of from about 100 to about 2,400 rotations per minute.

17. A process in accordance with claim 1, wherein the first superfinishing, the second superfinishing and the third superfinishing are accomplished at a pressure of from about 10 to about 100 psi.

18. A process in accordance with claim 1, wherein the first superfinishing, the second superfinishing and the third superfinishing are accomplished at an oscillation of from about 10 to about 100 percent.

19. A process in accordance with claim 1, wherein prior to a), the fuser roller is cleaned.

20. A process for renewing an outer surface of a used fuser roller by removing debris particles from the surface, the process comprising a) contacting the outer surface with a first finishing paper having a particle size of from about 10 to about 20 microns while simultaneously rotating the used fuser roller so that the first finishing paper completes a first superfinishing of the outer layer;

b) repeating a) to from about 1 to about 5 passes until obtaining a first measured gloss value of from about 10 to about 50 GGU;

c) contacting the outer surface with a second finishing paper having a particle size of from about 1 to about 20 microns while simultaneously rotating the used fuser roller so that the second finishing paper completes a second superfinishing of the outer layer;

d) repeating c) to from about 5 to about 10 passes until obtaining a second measured gloss value of from about 30 to about 70 GGU;

e) contacting the outer surface with a third finishing paper having a particle size of from about 1 to about 10 microns, while simultaneously rotating the used fuser roller so that the third finishing paper completes a third superfinishing of the outer layer; and f) repeating e) to from about 1 to about 10 passes until obtaining a third measured gloss value of from about 65 to about 80 GGU.

21. A process for renewing an outer surface of a used fuser roller by removing debris particles from the surface, the process comprising a) contacting the outer surface with a first silicon carbide finishing paper having a particle size of from about 10 to about 20 microns while simultaneously rotating the used fuser roller so that the first finishing paper completes a first superfinishing of the outer layer;

b) repeating a) to from about 1 to about 5 passes until obtaining a first measured gloss value of from about 10 to about 50 GGU;

c) contacting the outer surface with a second silicon carbide lapping film having a particle size of from about 1 to about 20 microns while simultaneously rotating the used fuser roller so that the second finishing paper completes a second superfinishing of the outer layer;

d) repeating c) to from about 5 to about 10 passes until obtaining a second measured gloss value of from about 30 to about 70 GGU;

e) contacting the outer surface with a third silicon carbide lapping paper having a particle size of from about 1 to about 10 microns, while simultaneously rotating the used fuser roller so that the third finishing paper completes a third superfinishing of the outer layer; and f) repeating e) to from about 1 to about 10 passes until obtaining a third measured gloss value of from about 65 to about 80 GGU.

* * * * *